US010415155B2

(12) United States Patent
Yoshida et al.

(10) Patent No.: US 10,415,155 B2
(45) Date of Patent: Sep. 17, 2019

(54) PRODUCTION METHOD OF HEMP FIBER FOR SPINNING AND HEMP FIBER FOR SPINNING

(71) Applicants: AVEX GROUP HOLDINGS INC., Tokyo (JP); Shinichirou Yoshida, Tokyo (JP)

(72) Inventors: Shinichirou Yoshida, Tokyo (JP); Keisuke Hishikawa, Tokyo (JP)

(73) Assignees: AVEX GROUP HOLDINGS INC., Tokyo (JP); Shinichirou Yoshida, Tokyo (JP)

( * ) Notice: Subject to any disclaimer, the term of this patent is extended or adjusted under 35 U.S.C. 154(b) by 234 days.

(21) Appl. No.: 15/500,519

(22) PCT Filed: Jul. 31, 2015

(86) PCT No.: PCT/JP2015/071870
§ 371 (c)(1),
(2) Date: Jan. 30, 2017

(87) PCT Pub. No.: WO2016/017815
PCT Pub. Date: Feb. 4, 2016

(65) Prior Publication Data

US 2017/0226662 A1 Aug. 10, 2017

(30) Foreign Application Priority Data

Jul. 31, 2014 (JP) ..... 2014-156921

(51) Int. Cl.
*D01C 1/02* (2006.01)
*D06M 11/00* (2006.01)
(Continued)

(52) U.S. Cl.
CPC ..... *D01C 1/02* (2013.01); *D02G 3/08* (2013.01); *D06M 11/00* (2013.01); *D06M 11/38* (2013.01);
(Continued)

(58) Field of Classification Search
CPC ..... D01C 1/02; D06M 11/00; D06M 16/00; D06M 11/38; D06M 16/003; D10B 2201/01
(Continued)

(56) References Cited

U.S. PATENT DOCUMENTS 4,568,739 A * 2/1986 Jaskowski ..... C08B 37/0045 435/275
7,481,844 B2 * 1/2009 Liu ..... D01C 1/00 8/107
(Continued)

FOREIGN PATENT DOCUMENTS

CN 1236409 A 11/1999
CN 102925991 A 2/2013
(Continued)

OTHER PUBLICATIONS

Chinese Office Action dated Sep. 5, 2018, for corresponding Chinese Application No. 201580041952.0.
(Continued)

*Primary Examiner* — Tajash D Patel
(74) *Attorney, Agent, or Firm* — Kinney & Lange, P.A.

(57) ABSTRACT

A production method of hemp fiber for spinning, the method including: an immersion treatment process of immersing raw hemp fiber in a treatment liquid including an alkali, water, and at least one type of enzyme selected from the group consisting of cellulose-degrading enzymes and glycosidic bond hydrolyzing enzymes for an immersion time of from 30 minutes to 60 minutes under conditions of a
(Continued)

temperature of from 60° C. to 100° C.; a water-washing process of washing the immersion treated hemp fiber with water; and a drying process of drying the water-washed hemp fiber.

5 Claims, 2 Drawing Sheets

(51) Int. Cl.
*D06M 16/00* (2006.01)
*D02G 3/08* (2006.01)
*D06M 11/38* (2006.01)
*D06M 101/06* (2006.01)

(52) U.S. Cl.
CPC ..... *D06M 16/00* (2013.01); *D06M 16/003* (2013.01); *D06M 2101/06* (2013.01); *D10B 2201/01* (2013.01)

(58) Field of Classification Search
IPC ..... D01C 1/02
See application file for complete search history.

(56) References Cited

U.S. PATENT DOCUMENTS 8,603,802 B2 * 12/2013 Sung ..... D01C 1/02 435/23
2010/0307703 A1 12/2010 Liu et al.
2011/0312066 A1 * 12/2011 Sung ..... D01C 1/02 435/277
2015/0079866 A1 * 3/2015 Chao ..... D04H 1/425 442/327

FOREIGN PATENT DOCUMENTS

JP 01139874 A 6/1989
JP 05247852 A 9/1993
JP 06346375 A 12/1994
JP H11222770 A 8/1999
JP 2010540785 A 12/2010

OTHER PUBLICATIONS

Ossola, Mattia, "Scouring of Flax Rove with the Aid of Enzymes", Enzyme and Microbial Technology, vol. 34, 2004, 10 pages.
International Search Report and Written Opinion from PCT Application Serial No. PCT/JP2015/071870, dated Oct. 20, 2015, 9 pages.
G. N. Ramaswamy, et al., "Uniformity and Softness of Kenaf Fibers for Textile Products," from Textile Res. J. 65(12), pp. 265-770, Dec. 1995.
Chinese Office Action dated Apr. 16, 2019, received for corresponding Chinese Application No. 201580041952.0.

* cited by examiner

PRODUCTION METHOD OF HEMP FIBER FOR SPINNING AND HEMP FIBER FOR SPINNING

BACKGROUND

Technical Field

The present invention relates to a production method of hemp fiber for spinning and hemp fiber for spinning.

Background Art

As warming phenomena have recently become a problem for Earth's environment, there is demand for materials having excellent cooling sensation in human clothing. The Popularity of hemp, this being a natural material that is light and dry to the touch, is increasing in the textiles market, and demand for hemp fiber cloth is growing.

Cotton fiber, which, like hemp, is a natural cellulose fiber, is derived from the seeds of a plant known as cotton, is a fiber that is soft itself, and has excellent spinnability and workability. In hemp, however, the raw material part employed in cloth manufacture is the leaf or stem of the plant. Since the leaf and stem are made of cellulose, and components such as lignin are present between the fibers, the fiber material has high strength but is also hard, with smooth fiber surfaces, making the material difficult to work, and cloth obtained by working the material sometimes feels rough, worsening the feel.

Technology for improving the feeling of cellulose fibers such as hemp fibers has been proposed, such as a method of treating the surface of cellulose-based fiber woven fabrics with a cellulolytic enzyme, and then with a strong alkaline aqueous solution (for example, see Japanese Patent Application Laid-Open (JP-A) No. H05-247852).

As a method of improvement of cellulose fiber cloths, a method has been proposed in which only the surface of the cellulose fiber cloth is treated with a cellulolytic enzyme, and hemp is described as an example of a cellulose fiber (for example, see JP-A No. H06-346375).

These technologies are technology concerned with improving the feel of woven fabric surfaces made from cellulose fibers such as hemp, and consideration has not been given to applying to working raw fiber materials with an object that is suitable for threads for spinning and the like.

Hemp fibers have high strength, but are stiff. Since hemp fibers have a smooth surface, there are therefore problems that when attempting to perform work in which hemp fibers are spun and the hemp thread obtained is weaved or knitted to make a woven product or a knitted product, hemp fibers are not easily caught by spinning devices generally employed for producing twisted threads, yield is low when the fiber is spun, fiber fall-off and thread breakage are liable to occur, and productivity is low. Moreover, since hemp fiber is stiff, twisted threads having a fine diameter, twisted threads having a uniform thread thickness, and the like are difficult to obtain, and this also causes a decrease in productivity in the production of fabrics and knitted products that employ these hemp threads.

Historically, methods of making raw fiber materials by splitting leaves and stems of plants such as hemp have been performed since ancient times. One such method performed since ancient times is a method employing a physical procedure in which hemp fibers are finely shredded, the fibers are beaten with a fulling block and are carded in order to remove substances such as lignin between cellulose fiber cells and soften the material.

Likewise in recent times, methods such as compressing hemp fibers between rollers before spinning the hemp fiber are used, but the current situation is that sufficient yields are not achieved when spinning. Moreover, although it is known that treating cellulose fibers with strong alkali or strong acid enhances softness, the strength of the fibers is notably reduced making this impractical.

Accordingly, many hemp fiber products that are currently distributed have a characteristic feeling caused by the unevenness of threads made from hemp fiber, and there is a desire to provide highly versatile, twisted hemp threads or hemp cloth that have softness similar to cotton.

As a method of improving hemp fibers, a method has been proposed for removing pectin, lignin, and the like present between hemp fiber cellulose by treating the hemp fibers with a treatment liquid including a cellulolytic enzyme, and it has been described that a hemp fiber having low skin irritancy and excellent spinnability can be obtained by this treatment (for example, see JP-A No. H01-139874).

SUMMARY OF INVENTION

Technical Problem

However, the working technology described by JP-A No. H05-247852 is technology related to surface working on cloth obtained by weaving or knitting fibers as described above, and no consideration is given to fiber treatments suitable for spinning.

The method described by JP-A No. H06-346375 is characterized by the application of a cellulolytic enzyme to only the surface of cloth, and it is stated that immersing the cellulose fiber in the cellulolytic enzyme lowers strength and is not preferable, and the method therefore makes no consideration of fiber treatment suited for spinning.

JP-A No. H01-139874 describes softness being held by removing lignin and the like in plant fibers such as hemp and cotton using an cellulolytic enzyme, and also describes an effect of suppressing skin irritancy of hemp fibers by rounding off and removing the edges of tips by dissolving the tips of the hemp fibers. However, in investigations by the present inventors, although it was recognized that the use of a cellulolytic enzyme has a somewhat effect on cotton fibers, it was confirmed that this was not enough for the surface of hemp fibers to be worked into a state appropriate for spinning employing a general spinning device.

Although the feeling and the like of the surface of the cloth is improved in such conventional treatment technology for hemp fiber, the physical properties of the fibers to be a cloth cannot be adjusted into a state suitable for spinning employing a spinning device, and the current situation is that a production method for hemp fiber that enables spinning with high industrial productivity has not yet been obtained.

One embodiment of the present invention is concerned with, by simple treatment, providing a production method of hemp fiber for spinning that is soft and that can be spun with high productivity. Another embodiment of the present invention is concerned with providing hemp fiber having excellent spinnability.

Solution to Problem

A solution to the problem includes the following aspects.

<1> A method of producing hemp fiber for spinning, comprising: immersing raw hemp fiber in a treatment liquid containing an alkaline agent, water, and at least one enzyme selected from the group consisting of cellulolytic enzymes and enzymes that hydrolyse a glycosidic bond, for from 30 minutes to 60 minutes at a temperature of from 60° C. to 100° C.; washing the immersion treated hemp fiber with water; and drying the washed hemp fiber.

<2> The method of producing hemp fiber for spinning of <1>, wherein the treatment liquid contains the alkaline agent in an amount such that a pH of the treatment liquid is 9 or greater.

<3> The method of producing hemp fiber for spinning of <1> or <2>, wherein the treatment liquid has a pH of from 11 to 13.

<4> The method of producing hemp fiber for spinning of any one of <1> to <3>, further comprising a post-treatment, after the washing, wherein the post-treatment comprises immersing the washed hemp fiber in a post-treatment liquid containing water and at least one compound selected from the group consisting of sodium nitrobenzenesulfonate and sodium cyanurate, for from 20 minutes to 50 minutes at a temperature of from 60° C. to 100° C.

<5> A hemp fiber for spinning that is obtained by the method of producing hemp fiber of any one of <1> to <4>, having a narrower fiber diameter than that of raw hemp fiber, being twisted, and having fine naps on a fiber surface.

One embodiment of the present invention can, by a simple treatment, provide a production method of hemp fiber for spinning that is soft and that can be spun with high productivity. Another embodiment can provide hemp fiber having excellent spinnability.

DESCRIPTION OF EMBODIMENTS

Figure 1A:
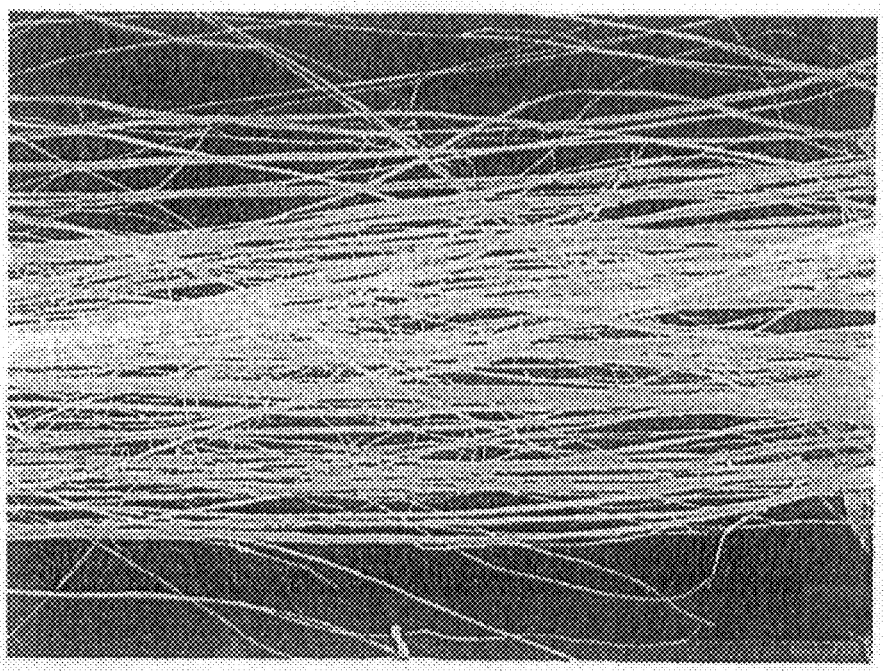
FIG. 1A is a photograph of an untreated, raw hemp fiber, captured enlarged by a microscope.

Detailed explanation follows regarding the present invention.

Production Method of Hemp Fiber for Spinning

A production method of hemp fiber for spinning, which is one embodiment of the present invention, includes: holding raw hemp fiber immersed in a treatment liquid including an alkaline agent, water, and at least one enzyme selected from the group consisting of cellulolytic enzymes and enzymes that hydrolyse a glycosidic bond (also referred to as a treatment liquid hereafter) for from 30 minutes to 60 minutes at a temperature of from 60° C. to 100° C. (also referred to as an immersion treatment process hereafter); washing the immersion treated hemp fiber with water (also referred to as an water-washing process hereafter); and drying the water-washed hemp fiber (also referred to as a drying process hereafter).

In the present specification, "raw hemp fiber" refers to hemp fiber prior to carrying out any of the treatments in the production method of hemp fiber for spinning, this being the raw form of hemp fiber for spinning.

The mechanism of the present embodiment is not clear, but is thought to be as follows.

In the production method of the present embodiment, the treatment liquid including an alkaline agent and at least one enzyme selected from the group consisting of cellulolytic enzymes capable of degrading cellulose and enzymes that hydrolyse a glycosidic bond is heated, and hemp fiber is immersion treated in the heated treatment liquid such that the alkaline agent functions to promote permeation by the treatment liquid and, due to swelling, the hemp fiber becomes more easily permeable to moisture than in cases in which the hemp fiber is immersed in treatment liquid that includes only an enzyme capable of degrading cellulose. As the treatment liquid causes the fiber to swell, moisture together with enzymes enters between fibers and stay there, making the fiber in a state in which lignin and the like present between cellulose swells and is easily removed, and make the fiver soft. Lignin and the like present between cellulose is removed, by water-washing and drying the treated fiber, and voids between cellulose are fixed. Thus, on the surface of the hemp fiber, fine naps are generated at places where the lignin and the like between cellulose has been removed. Moreover, fine hollow portions are formed at a central portion of the fiber, fibrillation proceeds, and twisting occurs in the fibers with the washing and drying after the immersion treatment process. Thus, it is hypothesized that hemp fiber is produced that has napping on the surface, that has softness and twisting, and that is easily caught by a spinning device.

Note that the present embodiment is not limited in any way by this hypothesized mechanism.

Explanation follows regarding the production method of hemp fiber for spinning of the present embodiment, in order of the processes.

Immersion Treatment Process

In the production method of hemp fiber for spinning of the present embodiment, raw hemp fiber is immersion treated in the treatment liquid that contains an alkaline agent, water and at least one enzyme selected from the group consisting of cellulolytic enzymes and enzymes that hydrolyze glycosidic bond given below.

Hemp Fiber

Although hemp fiber is often used to refer to ramie and flax, hemp fiber is not limited to hemp fibers of this narrow meaning in the present specification.

The raw hemp fiber applicable to the production method of hemp fiber for spinning of the present embodiment may be any hemp fiber. Hemp fiber in the present specification is, for example, used with a meaning that encompasses any hemp fiber derived from the hemp plants listed below.

Specific examples include cannabis (*Cannabis sativa* (Moraceae)), also known as hemp, flax (*Linum usitatissimum* (Linaceae)), ramie (*Boehmeria nivea* var. *nipononivea* (Urticaceae)), also known as "choma" or "karamushi" in Japanese, kenaf (*Hibiscus cannabinus* (Malvaceae)), also known as "youma" in Japanese, jute (*Corchorus capsularis* (Tiliaceae)), Nalta jute (*Corchorus olitorius* (Tiliaceae)), Manila hemp (*Musa textilis* (Musaceae)), ambari of Malvaceae, gumbo hemp, Bombay hemp, sisal hemp (*Agave sisalana* (Agavoideae)), cannabis, lesser New Zealand flax, New Zealand hemp (*Phormium tenax* (Agavoideae)), China grass, and jute (*Corohorus olitorius* (Tiliaceae)), also known as "shimatsunaso" in Japanese.

Moreover, jute, which is a hemp fiber obtained from *Corchorus capsularis* or *Corohorus olitorius*, is also encompassed in hemp fiber in the present specification.

Of the hemp fibers described above, the production method of the present embodiment is preferably applied to hemp, ramie, flax, or the like from the viewpoints of productivity in industrial scale and easiness to obtain the raw material.

The production method of fiber for spinning of the present embodiment is also effective on fibers that are rigid cellulose fibers obtained from the leaves of *Cyperus monophyllus* Vahl, *Musa basjoo*, or banana, the leaves and stalks of *Alpinia zerumbet*, and the bark, stems, leaves, and the like of *Cyperus papyrus, Schefflera arboricola, Broussonetia kazinoki×B. papyrifera, Edgeworthia chrysantha, Diplomorpha sikokiana, Salix species*, bamboos, and *Nelumbo nucifera*. However, the production method of hemp fiber for spinning of the present embodiment has a notable advantageous effect of improving productivity when employed with hemp fiber.

There are no particular limitations to the method of obtaining hemp fiber from plants, and a known method may be employed. Ordinarily, a plant (hemp) as the raw material is immersed in an aqueous solution that contains water and a chemical such as an acid, and fiber strings are taken out, water-washed, and dried to obtain hemp fiber.

Pre-Treatment of Hemp Fiber

In the production method of the present embodiment, the raw hemp fiber may first cut into lengths of from approximately 2 cm to approximately 20 cm to facilitate working. The length may be appropriately determined according to the characteristics of the hemp fiber employed as the raw material, and cutting to a length of from approximately 2 cm to approximately 15 cm is preferable.

The length of the raw hemp fiber is, for example, preferably from approximately 8 cm to approximately 12 cm when the raw hemp fiber is hemp, is preferably from approximately 3 cm to approximately 6 cm when the raw hemp fiber is ramie, and is preferably from approximately 2 cm to approximately 5 cm when the raw hemp fiber is flax. However, there are not limitations there to.

According to the production method of the present embodiment, softness and workability can be improved even when the raw hemp fibers employed are long fibers. Thus, although raw hemp fibers are often employed at a length of from 3.5 cm to 5.5 cm conventionally, for example, raw hemp fibers cut to a length of from 7 cm to 13 cm are also suitable for use. Generally, the longer the fiber length, the more effectively skin irritation caused by the hemp fiber is suppressed, and the more applicability to spinning devices is improved.

The cut raw hemp fiber may be immersed in water, and then immersed in the treatment liquid that contains the cellulolytic enzyme or the like, the alkaline agent, and water.

The raw hemp fiber may be pre-washed prior to immersion in the treatment liquid, and may be immersed in an aqueous solution that contains an alkaline agent (also referred to as an alkaline agent-containing aqueous solution hereafter) such as an aqueous sodium hydroxide solution for removing dirt from the raw hemp fiber, and then may be water-wash treated. The alkaline agent-containing aqueous solution employed in the pre-treatment of the raw hemp fiber preferably has a concentration of from 3% by mass to 10% by mass for the purpose of removing dirt adhered to the fiber. Immersion of the raw hemp fiber in the alkaline agent-containing aqueous solution for the purpose of washing may be performed without heating the alkaline agent-containing aqueous solution, at a temperature of from approximately 10° C. to approximately 25° C., this being the temperature of the water employed to prepare the aqueous solution, or may be performed by heating the alkaline agent-containing aqueous solution to a temperature of approximately 80° C. The immersion time is preferably from approximately 40 minutes to approximately 120 minutes in cases in which the aqueous solution is not heated, and is preferably from approximately 20 minutes to approximately 40 minutes in cases in which the aqueous solution is heated.

Explanation follows regarding components contained in the treatment liquid that is employed in the immersion treatment process, and that contains acellulolytic enzyme or the like, an alkaline agent, and water.

At Least One Enzyme Selected from the Group Consisting of Cellulolytic Enzymes and Enzymes that Hydrolyze a Glycosidic Bond The treatment liquid employed in the immersion treatment process contains at least one enzyme selected from the group consisting of cellulolytic enzymes and enzymes that hydrolyze a glycosidic bond (also referred to as "cellulolytic enzyme or the like" here).

Preferable examples of the enzyme employed to prepare the treatment liquid are given below.

Cellulase, hemicellulase, and the like are known cellulolytic enzymes, and any known cellulolytic enzyme may be employed.

The enzymes that hydrolyze a glycosidic bond are enzymes that have the function of hydrolyzing glycosidic bonds in cellulose, and that act similarly to cellulolytic enzyme. Examples thereof include amylase, saccharase, maltase, sucrase, and lactase.

Of these, from the viewpoint of advantageous effects, cellulase is preferable as the cellulolytic enzyme or the like.

Cellulase can be obtained as commercial products such as CELLACID or BIOACID (trade names; manufactured by Servicetec Japan Corporation).

Alkaline Agent

The treatment liquid employed in the immersion treatment process contains an alkaline agent.

Examples of the alkaline agent include sodium hydroxide, potassium hydroxide, sodium sulfate, and caustic lime.

Including a cellulolytic enzyme or the like and an alkaline agent in the treatment liquid makes the permeability of the enzyme toward the fiber excellent in the immersion treatment process. Moreover, on the fiber surface, the solubility of lignin and the like is improved due to the functioning of the alkaline agent, which operates in cooperation with the functioning of the cellulolytic enzyme or the like such that the obtained hemp fiber becomes a soft fiber that includes numerous voids in the central portion, and that has fine naps on the surface, and the hemp fiber is obtained with properties suitable for spinning.

Since the cellulose of the raw hemp fiber has stiff physical properties, hemp fiber having physical properties suitable for spinning is difficult to obtain from treatment liquid that contains a cellulolytic enzyme or the like alone. However, according to the production method of the present exemplary embodiment, combining the cellulolytic enzyme or the like and the alkaline agent enables production of hemp fiber having physical properties suited for spinning.

Solvent

Water is preferably employed as the solvent of the enzyme treatment liquid. The solvent may employ water alone. Water serving as the solvent may further include citric acid or the like at from 2% by mass to 10% by mass with respect to all of the solvent, for the purpose of softening the fiber.

Preparation of Treatment Liquid

The treatment liquid may be prepared by placing from 5 equivalents to 20 equivalents of solvent with respect to the mass of the raw hemp fiber into a container, adding the alkaline agent and the at least one enzyme selected from the group consisting of cellulolytic enzymes and enzymes that hydrolyze a glycosidic bond, agitating well, and heating the liquid temperature to from 60° C. to 100° C.

The treatment liquid may contain one type, two types, or more types of the cellulolytic enzyme or the like.

The total content of the enzyme in the treatment liquid is preferably from 3 parts by mass to 10 parts by mass with respect to 100 parts by mass of the raw hemp fiber, and is more preferably from 3 parts by mass to 5 parts by mass with respect to 100 parts by mass of the raw hemp fiber.

One type, two types, or more types of alkaline agent may be contained in the treatment liquid.

The content of the alkaline agent in the treatment liquid is preferably an amount that sets the pH of the treatment liquid to 9 or greater, and is more preferably a content that sets the pH of the treatment liquid to from 11 to 13.

A content of alkali within this range tends to result in favorable treatment effects, without lowering the strength of the fiber.

The pH of the treatment liquid may be adjusted by the type and amount of the alkaline agent employed, or may be adjusted by a pH control agent.

The pH of the treatment liquid may be measured by a known pH meter. A pH meter HM-30R (trade name, manufactured by DKK-TOA Corporation) or the like may be employed as the pH meter.

In the present specification, the pH of the treatment liquid employs a value measured as 25° C.

Additives

In addition to the enzyme, the alkaline agent, and water serving as the solvent, various additives may be added to the treatment liquid according to the object, within a range that does not hinder the effects of the present exemplary embodiment.

Immersion Treatment

Hemp fiber, on which pre-treatments such as washing have been performed if desired, is immersed in the prepared treatment liquid.

The cut hemp fiber is immersed for an immersion time of from 30 minutes to 60 minutes with the liquid temperature of the treatment liquid kept under a condition of a temperature of from 60° C. to 100° C.

From the viewpoint of effectiveness, the liquid temperature of the treatment liquid during immersion is more preferably from 80° C. to 100° C. The immersion time is more preferably from 35 minutes to 50 minutes.

Immersion is preferably performed while agitating the treatment liquid so that the hemp fiber and the enzyme make sufficient contact and permeation of the treatment liquid between fibers is promoted during immersion.

From such viewpoints, the immersion treatment of the hemp fiber is preferably performed using a container or device equipped with an agitation device. From the viewpoint of being able to agitate while maintaining the temperature conditions during immersion, a washer machine, a paddle machine, an Obermaier machine, or the like, which are known dying machines, is also preferably employed in the immersion treatment.

Moreover, the permeation of the treatment liquid into the hemp fiber can also be promoted by supplying a gas to bubble through the treatment liquid.

Although immersion treatment performed using a container or device equipped with temperature regulating functionality is also a preferable mode, there is no particular limitation thereto. The temperature regulation of the treatment liquid can be performed by a known method such as heating from outside the container or heating by an immersion heater or the like.

Water-Washing Process

The hemp fiber that has been immersed in the treatment liquid is taken out of the container containing the treatment liquid, and the water-washing process is applied.

Water-washing liquid employed in the water-washing process may be water-washing liquid that contains water alone, or may be water-washing liquid containing a known additive in addition to water if desired.

The water employed in the water-washing process may be tap water.

In the water-washing process, the hemp fiber is sufficiently washed to remove the treatment liquid, alkaline agent, and the like remaining on the fiber surface and in voids within the fibers.

The water-washing liquid employed in the water-washing process may contain a surfactant. Including a surfactant in the water-washing liquid further improves the washing effect of removing components remaining between fibers. After having been washed by the water-washing liquid that includes the surfactant, water-washing is preferably performed using a water-washing liquid that does not include a surfactant to remove the surfactant from the fiber.

The water-washing may be performed using flowing water, or may be performed by placing in a container containing water and agitating. In cases in which water-washing is performed in a container, the water is preferably changed at least one or two times.

Post-Treatment Process

After the water-washing process, a drying process, described later, is applied to the hemp fiber from which the treatment liquid has been removed.

A post-treatment process is preferably performed prior to drying. Performing the post-treatment process fixes voids in the hemp fiber and the napping state formed by swelling due to the enzyme, enabling hemp fiber that has physical properties suited to spinning to be obtained.

The post-treatment is performed by immersing the water-washed hemp fiber in a post-treatment liquid that contains water and at least one compound selected from the group consisting of sodium nitrobenzenesulfonate and sodium cyanurate (also referred to as a post-treatment agent hereafter), and holding the hemp fiber immersed for from 20 minutes to 50 minutes while maintaining the liquid temperature at from 60° C. to 100° C.

Sodium nitrobenzenesulfonate and sodium cyanurate are known dye stabilizing agents and can be obtained as commercial products.

One type of post-treatment agent alone, or two types of post-treatment agent, may be included in the post-treatment liquid.

The total content of the post-treatment agent in the post-treatment liquid is preferably from 2% by mass to 10% by mass and is more preferably from 2% by mass to 4% by mass.

The mechanism of the post-treatment process is not clear, but is hypothesized to be as follows.

It is thought that by applying at least one type of compound selected from sodium nitrobenzenesulfonate or sodium cyanurate to the hemp fiber that has been through the immersion treatment process, the acidic group included in the sodium nitrobenzenesulfonate or sodium cyanurate creates a hydrogen bonding interaction with moisture contained in the hemp fiber, and bonds to voids within the hemp fiber formed by swelling and to the naps on the hemp fiber surface, and effectively holds that form.

The hemp fiber that has been through the post-treatment process is water-washed to remove the post-treatment liquid, and the drying process is applied.

Drying Process

The hemp fiber that has been through the immersion treatment process in the enzyme treatment liquid, the water-washing process, and the post-treatment process performed if desired, is dried to obtain hemp fiber for spinning.

Drying of the fiber can be performed using ordinary methods. The device employed for drying may be, for example, a known band-type drying machine that employs a net or belt, a tumble drying machine for fibers, a non-contact-type dome-style drying machine that employs infrared, or a drying machine that dries using electromagnetic waves such as a microwave oven.

The drying temperature is preferably an atmosphere temperature of from approximately 90° C. to approximately 180° C. The temperature of the hemp fibers is heated to approximately 100° C. in cases of drying by direct heating using electromagnetic waves.

The hemp fibers need not be dried to a fully dry state in the drying process; drying to a dried state at which preservation or employment in a spinning device is not hindered is sufficient.]

In the hemp fiber obtained by the production method of hemp fiber for spinning of the present embodiment, twisting occurs caused by fine voids present between fibers, the hemp fibers are soft, and there are abundant fine naps on the surface.

Thus, in cases in which the hemp fiber is applied to a general purpose spinning device, fall-off of the fiber is suppressed, and twisted hemp fiber threads can be obtained with high productivity.

The obtained hemp fiber for spinning is carded to form a sliver using an ordinary method, and then supplied to a spinning device.

Hemp Fiber for Spinning

The hemp fiber for spinning obtained by the production method of hemp fiber for spinning of the present embodiment described above has a narrower fiber diameter than raw hemp fiber, has twisting, and has fine naps on the fiber surface.

Namely, the hemp fiber for spinning of the present embodiment is in a form in which fine fibers that were previously fused are separated by removing lignin and the like included in the raw hemp fiber, and fiber having a narrower fiber diameter than raw hemp fiber is observed. Moreover, twisting arises due to fine voids present between the fibers, imparting stretchiness, and there is softness. Moreover, since the surface has abundant fine naps, fall-off of the fiber is suppressed, and twisted threads of uniform thickness are formed with good productivity when the fiber is applied to a standard spinning device.

Namely, in the hemp fiber for spinning of the present exemplary embodiment, twisting arises caused by fine voids present between fibers, increasing stretchiness, and since there is softness and abundant fine naps on the surface, fall-off of the fiber is suppressed, and twisted threads of uniform thickness are formed with good productivity when the fiber is applied to a general-purpose spinning device.

The form, external appearance, and cross-section of the hemp fiber for spinning can be observed by an optical microscope. The magnification ratio when observing using an optical microscope is preferably from 300× to 1500×, but the magnification ratio is not particularly limited.

For example, in cases in which the entire hemp fiber for spinning is observed, a magnification ratio of from approximately 300× to approximately 400× is well-suited for this observation, and when the napping state of the surface or a portion such as the cross-section is observed, a magnification ratio of from approximately 1,000× to approximately 1,500× is well-suited for this observation.

Capture of optical micrographs employed in observation of the hemp fiber for spinning of the present embodiment was contracted to Tokyo Metropolitan Industrial Technology Research Institute, Sumida Branch, Human Life Technology Development Sector.

Uniform twisted threads with a finer yarn count than conventional hemp fiber can be easily obtained since the hemp fiber for spinning of the present embodiment has softness that is absent in conventional hemp fibers.

Thus, application can be made to various thin, soft final products such as clothing, underwear, and scarves that are conventionally difficult to form using hemp fiber.

EXAMPLES

More specific explanation follows regarding examples of the present embodiment, but the present embodiment is not in any way restricted to these examples.

Example 1

Hemp was cut into 10 cm lengths to prepare 100 g of raw hemp fiber for treatment.

An alkaline pre-treatment liquid having a pH of 11 was prepared using a 25% by mass sodium hydroxide aqueous solution, the 100 g of raw hemp fiber was added to the pre-treatment liquid, and dirt was removed by immersing the raw hemp fiber for 45 minutes at 90° C. The hemp fiber was taken out from the alkaline pre-treatment liquid, well water-washed, and dried.

2 kg of water was placed in a stainless steel container, 4 g of cellulase (CELLACID VS-2: trade name, manufactured by Servicetec Japan Corporation) and 4 g of a 25% by mass sodium hydroxide aqueous solution were added and well agitated to prepare a treatment liquid. The pH of the treatment liquid was measured using a pH meter (HM-30R: trade name, manufactured by DKK-TOA Corporation). The pH was 11 at 25° C.

The treatment liquid was heated to 60° C., 100 g of the raw hemp fiber from which dirt had been removed by treatment with the alkaline pre-treatment liquid was immersed in the treatment liquid, the liquid temperature was kept at 60° C., and the raw hemp fiber was held immersed for 30 minutes while agitating.

Afterward, the hemp fiber was taken out from the treatment liquid, washed with flowing water, gently wrung, and then placed in a 20d nylon mesh bag and dried for 45 minutes using a tumble drying machine to obtain a hemp fiber for spinning of Example 1.

The obtained hemp fiber for spinning of Example 1 was observed by eye and a tactile was sensory evaluated. It was confirmed that the hemp fiber for spinning of Example 1 was bulky and soft compared to hemp fiber prior to working (raw hemp fiber), and the feel was improved.

Figure 1B:
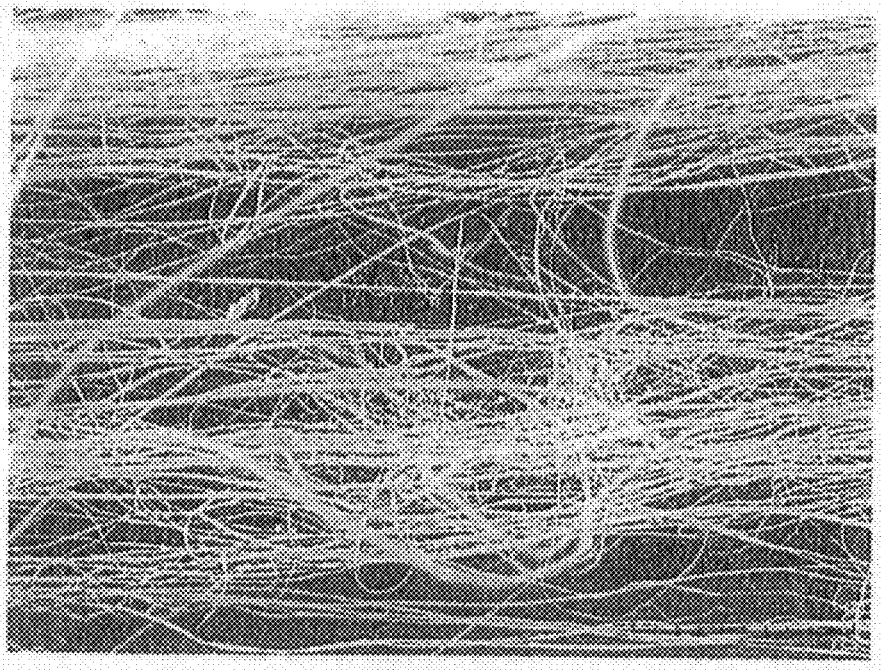
FIG. 1B is a photograph of a hemp fiber for spinning obtained in Example 1, captured enlarged by a microscope.

FIG. 1A is a photograph of the raw hemp fiber before treatment, enlarged by a microscope. FIG. 1B is a photograph of the hemp fiber obtained in Example 1, enlarged by a microscope. By observation with the microscope, it was found that the hemp fiber was fibrillated with narrow diameter fibers in a more divided state than the raw hemp fiber, and twisting was arising in fibers that had been linear.

The obtained hemp fiber for spinning was also observed by an optical microscope (magnification ratio of 400×).

Figure 2A:
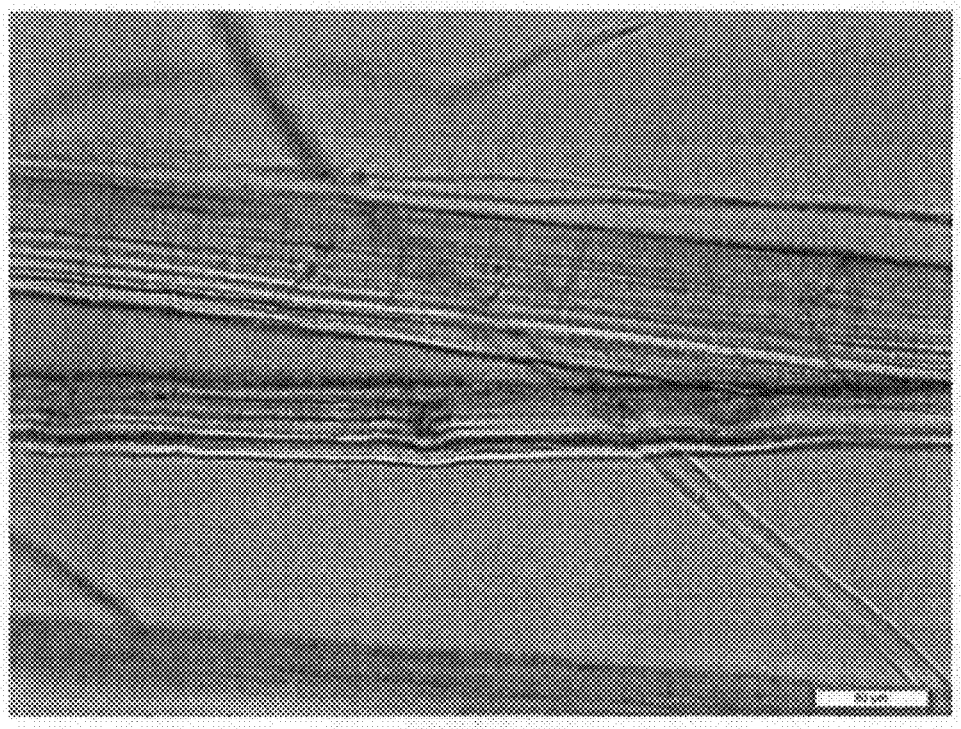
FIG. 2A is a micrograph of an untreated, raw hemp fiber, captured by an optical microscope at a magnification ratio of 400×.
Figure 2B:
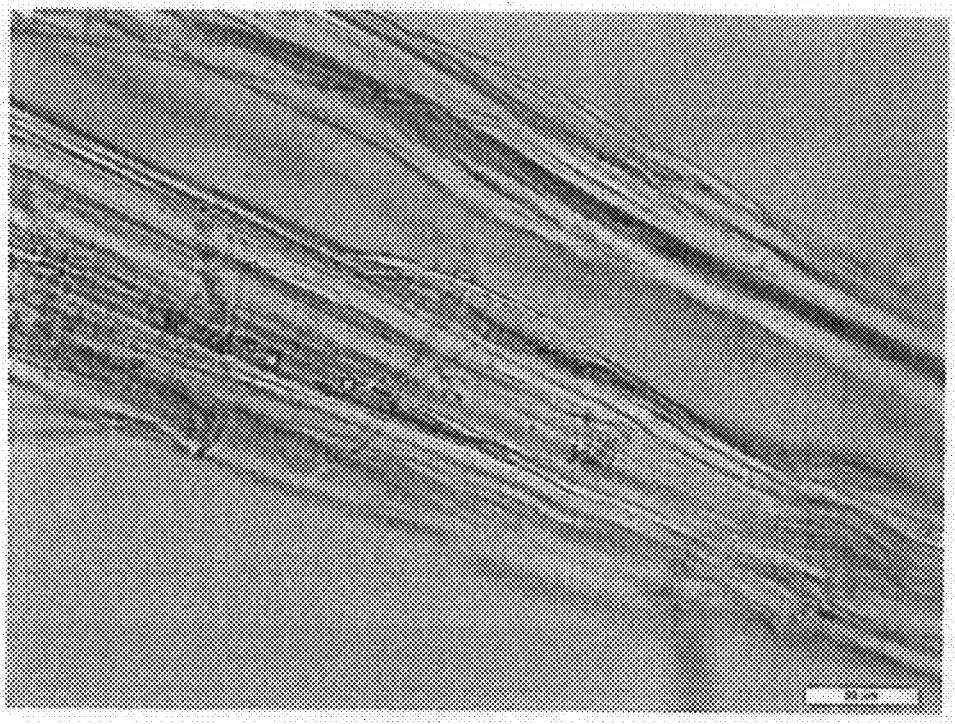
FIG. 2B is a micrograph of a hemp fiber for spinning obtained in Example 1, captured by an optical microscope at a magnification ratio of 400×.

FIG. 2A is a photograph of the raw hemp fiber prior to treatment captured by an optical microscope at a magnification ratio of 400×, and FIG. 2B is a photograph of the hemp fiber for spinning obtained in Example 1, captured by an optical microscope at a magnification ratio of 400×.

In the hemp fiber for spinning obtained by Example 1, the diameter of fiber aggregates was larger than in the raw hemp fiber prior to treatment, which was smooth and linear, due to swelling. It was observed that fibers having a narrower diameter than the raw hemp fiber due to split of threads and/or broken of threads, and naps and cracking on the surface of the each of the narrow diameter fibers.

Comparative Example 1

A treatment liquid containing the enzyme and water was prepared, which was employed in the treatment liquid of Example 1, without adding the 4 g of 25% by mass sodium hydroxide aqueous solution.

The hemp fiber for spinning of Comparative Example 1 was obtained similarly to in Example 1, except that sodium hydroxide was not included in the treatment liquid.

The obtained hemp fiber of Comparative Example 1 was observed by eye and tactile was sensory evaluated. The softness was slightly increased over that of the raw hemp fiber prior to working, but no large change was found.

An observation by an optical microscope at a magnification ratio of 400× was performed, naps on a side face of the fiber, swelling of the fiber, and increases in cracking and narrow diameter fibers were inferior to those of the hemp fiber for spinning of Example 1.

Example 2

Hemp was cut into 10 cm lengths to prepare 100 g of raw hemp fiber for treatment.

2 kg of water was placed into a stainless steel container, 4 g of cellulase (CELLACID VS 2: trade name, manufactured by Servicetec Japan Corporation) and 4 g of 25% by mass sodium hydroxide aqueous solution were added and well agitated to prepare the treatment liquid as in Example 1.

The treatment liquid was heated to 60° C., the prepared 100 g of raw hemp fiber was immersed in the treatment liquid, the liquid temperature was kept at 60° C., and the raw hemp fiber was held immersed for 30 minutes while agitating.

After immersion, the hemp was lifted out from the stainless steel container, the treatment liquid placed in the stainless steel container was removed, the container was water-washed, and then 500 g of new water and 2 g of sodium nitrobenzenesulfonate were placed in the stainless steel container and well agitated to prepare a post-treatment liquid.

The hemp lifted out from the treatment liquid was placed in the post-treatment liquid, the liquid temperature was heated to 60° C., and the hemp was immersed for 20 minutes while maintaining a temperature of 60° C. to perform the post-treatment.

After the post-treatment process, the hemp was water-washed with flowing water, gently wrung, and then placed in a 20 d nylon mesh bag and dried for 45 minutes using a tumble drying machine to obtain hemp fiber for spinning of Example 2.

The obtained hemp fiber for spinning was observed by an optical microscope (magnification ratio: 400×). Naps on the surface due to split of threads and/or broken of threads were observed on a side face of the fiber. Moreover, the cross-section of the threads was observed. It was confirmed that hollow portions were formed in the fiber, and that the fibers were in an aggregated state, and the attregates are formed from fibers having a smaller diameter than the raw fiber prior to working, and that the peripheral edges of the aggregats were swollen to a greater fiber diameter than the raw hemp fiber.

The hemp fiber for spinning of Example 1 was compared with the hemp fiber for spinning of Example 2. The cross-section diameter of the thread was greater in the hemp fiber for spinning of Example 2, and it is thought that the voids within the fiber were further enlarged by the post-treatment process.

The results showed that the swollen fibrous form given by the immersion treatment process using the enzyme treatment liquid is maintained in a more favorable state due to performing the post-treatment process. This is thought to be because hydrogen bonding interactions are formed by the post-treatment liquid at the expanded portions of the cellulose fibers, thereby the shape of gaps and naps of the fiber is kept even after removing moisture and drying.

The entire content of the disclosure of Japanese Patent Application No. 2014-156921 filed Jul. 31, 2014 is incorporated by reference in the present specification.

All publications, patent applications and technical standards mentioned in the present specification are incorporated by reference in the present specification to the same extent as if each individual publication, patent application, or technical standard was specifically and individually indicated to be incorporated by reference.

The invention claimed is:

1. A method of producing hemp fiber for spinning, comprising:

immersing raw hemp fiber in a treatment liquid containing an alkaline agent, water, and at least one enzyme selected from the group consisting of cellulolytic enzymes and enzymes that hydrolyse a glycosidic bond, for from 30 minutes to 60 minutes at a temperature of from 60° C. to 100° C.;

washing the hemp fiber with water after the immersing; and drying the hemp fiber after the washing.

2. The method of producing hemp fiber for spinning of claim 1, wherein the treatment liquid contains the alkaline agent in an amount such that a pH of the treatment liquid is 9 or greater.

3. The method of producing hemp fiber for spinning of claim 1, wherein the treatment liquid has a pH of from 11 to 13.

4. The method of producing hemp fiber for spinning of claim 1, further comprising a post-treatment, after the washing, wherein the post-treatment comprises immersing the hemp fiber in a post-treatment liquid containing water and at least one compound selected from the group consisting of sodium nitrobenzenesulfonate and sodium cyanurate, for from 20 minutes to 50 minutes at a temperature of from 60° C. to 100° C.

5. A hemp fiber for spinning that is obtained by the method of producing hemp fiber of claim 1, having a narrower fiber diameter than that of raw hemp fiber, being twisted, and having fine naps on a fiber surface.

* * * * *